US005192338A

United States Patent [19]

Waugh et al.

[11] Patent Number: 5,192,338

[45] Date of Patent: Mar. 9, 1993

[54] COAL ASH MODIFICATION AND REDUCTION

[75] Inventors: Allan B. Waugh, Sutherland; Keith M. Bowling, Turramurra, both of Australia

[73] Assignee: Commonwealth Scientific and Industrial Research Organisation, Australia

[21] Appl. No.: 863,535

[22] Filed: Apr. 6, 1992

Related U.S. Application Data

[63] Continuation of Ser. No. 478,005, May 1, 1990, abandoned.

[30] Foreign Application Priority Data

Sep. 3, 1987 [AU] Australia ..... PI4128

[51] Int. Cl.[5] ..... C10L 9/02

[52] U.S. Cl. ..... 44/627; 44/621

[58] Field of Search ..... 44/627, 621

[56] References Cited

U.S. PATENT DOCUMENTS

| | | | |
|---|---|---|---|
| 3,988,120 | 10/1976 | Chia | 44/622 |
| 4,105,416 | 8/1978 | Burk, Jr. et al. | 44/624 |
| 4,490,238 | 12/1984 | Siskin | 208/11 LE |
| 4,560,390 | 12/1985 | Bender | 44/15 R |
| 4,583,990 | 4/1986 | McGarry et al. | 44/627 |
| 4,705,530 | 11/1987 | Blytas et al. | 44/621 |
| 4,705,531 | 11/1987 | Blytas et al. | 44/621 |
| 4,741,741 | 5/1988 | Salem et al. | 44/627 |
| 4,753,033 | 6/1988 | Kindig | 44/627 |
| 4,936,045 | 6/1990 | Waugh et al. | 44/627 |

FOREIGN PATENT DOCUMENTS

| | | |
|---|---|---|
| 171005 | 4/1974 | New Zealand . |
| 175445 | 1/1976 | New Zealand . |
| 193206 | 12/1982 | New Zealand . |
| 199964 | 9/1985 | New Zealand . |
| WO87/02024 | 4/1987 | PCT Int'l Appl. . |
| 2071 | of 1909 | United Kingdom . |
| 2094830 | 9/1982 | United Kingdom . |

*Primary Examiner*—Ellen McAvoy

*Attorney, Agent, or Firm*—Millen, White, Zelano and Branigan

[57] ABSTRACT

A process for the selective removal or chemical modification of minerals contained in carbonaceous materials, comprising treating with an aqueous solution of a compound selected from ammonium salts, polyhydroxy alcohols, organic acids, organic complexing agents and polysaccharides. The process may be used to increase coal recovery, improve coal quality and enhance coal ash fusion characteristics.

11 Claims, 1 Drawing Sheet

1.) TREATED COAL
2.) STARTING COAL

1.) TREATED COAL
2.) STARTING COAL

COAL ASH MODIFICATION AND REDUCTION

This application is a continuation of application Ser. No. 07/478,005, filed May 1, 1990, now abandoned.

TECHNICAL FIELD

This invention relates to the beneficiation of carbonaceous materials, particularly black coals, using a chemical treatment process adapted for the removal or alteration of selected minerals.

BACKGROUND ART

Australian black coals are generally low in sulfur and trace elements but have a high ash yield which is usually a refractory ash, that is, it has a high ash fusion temperature, compared with overseas coals. This refractory ash reflects the high silica and kaolin clay content in the coal.

There are however some coals in Australia and many coals originating from overseas that have appreciable contents of other minerals which are more reactive and detract from the quality of the coal and/or hinder its industrial application.

In conventional coal washeries, as described in "An Introduction To Coal Preparation" edited by members of the executive committee of the Coal Preparation Society of NSW (1985), the main objective is to lower the ash yield of the coal without appreciable size reduction. The coal size generally ranges from about 150 mm to below 0.5 mm and depending on the size range, different washing techniques are used to separate the minerals and high ash coal from the coal rich fraction.

It is to be noted that the majority of techniques are based on the separation by density differences between coal at 1.3SG and minerals at 2.5SG. However, none of these methods are intended to alter the relative proportion of the individual minerals present in the coal. Thus any selective separation on size reduction or beneficiation at the washery is usually incidental.

It is known in the art that there are a variety of specialized, sophisticated chemical leaching techniques to demineralize coal wherein all of the minerals are removed to produce ultra-clean coal, that is coals having an ash of less than 1%. These methods are generally used to remove all minerals unselectively. Typically such methods employ hydrofluoric acid or fluoride salts as described by Lloyd, R. and Turner, M. J. (Kinneret Enterprises Ltd.) Patents pending and by Das, S. K. "Electrode grade carbon from coal by acid leaching process", Light Metals, 575 (1979); aqueous caustic soda solutions as described by Meyers, R. A, Hart, W. D. and McClanathan, L. C. "Gravimelt process for near complete chemical removal", Coal Processing Technology, 7, 89. (C.E.P. Technical Manual published by the American Institute of Chemical Engineers) (1981) and aqueous caustic soda solutions under autoclave conditions as described by the present inventors in "Removal of Mineral Matter from Bituminous Coals by Aqueous Chemical Leaching" Fuel Processing Technology, 9 217-233 (1984), "Demineralisation—A New Approach to Old Problems in the Utilisation of Solid Fuels", Proc. Aust. Inst. Energy Nat. Conf., Melbourne 347-357 (1985) and "An integrated, physical and chemical approach to coal beneficiation" Proc. CHEMECA 86, Adelaide, 297-302 (1986).

Additionally, selective chemical leaching has been used to remove pyrites from coal. The methods used are reviewed by Morrison, G. F. "Chemical desulphurisation of coal". Report No. ICTIS/TR15 I.E.A. Coal Research, London, June 1981. In this review the author categorizes the reactions possible as displacement reactions, acid/base neutralization, oxidation or reduction. It is noted that these methods are selective for pyrites only.

Another selective chemical leaching process is the ion exchange method used on lignites or brown coal to exchange calcium, magnesium, aluminium, iron and other cations from the carboxylate and phenate salts in the coal structure. These ion exchange processes are described by Bowling K. McG. and Rottendorf, H. R. in Austrailian patent specification 472,900, New Zealand patent specification 171,005 and Canadian patent specification 100,023 and in "Demineralised brown coal as an alternative to current hydrocarbon resources" Proc. 4th National Conf. Chem. Eng. Adelaide, 86-91 (1976). In this ion exchange method various solutions of salts and acids are used but there is no removal of minerals which are not chemically combined minerals, apart from quartz by fluoride salts.

DISCLOSURE OF THE INVENTION

The present inventors have realized that there is benefit to be gained by selectively removing minerals such as mineral sulfates, carbonates, phosphates, hydroxides and other mineral salts from black coals and other carbonaceous materials. The benefits to be gained by the selective removal of such mineral salts broadly include increasing coal recovery and improving coal quality.

The present inventors have found that by the treatment of black coals and other carbonaceous materials with selective chemical reagents, it is possible to remove the aforementioned reactive minerals present in the coal. In addition, if the reactive minerals present are bonding or cementing some of the silicates and oxides to the coal, then removal of the cementing minerals allows the silicates and oxides to be liberated and thereby more readily removed by standard washery techiques.

Accordingly, the present invention consists in a process for the beneficiation of a carbonaceous material which contains at least one mineral, comprising forming an aqueous solution of an effective amount of a compound selected from the group consisting of ammonium salts, polyhydroxyl alcohols, organic acids excluding sulphur containing organic acids, organic complexing agents capable of complexing with metal ions, and polysaccharides, which compound will react with the at least one mineral; contacting said carbonaceous material with said solution at a temperature less than the boiling point of said solution for a sufficient time to allow the compound to react with the at least one mineral to selectively remove or chemically modify at least one mineral contained in said carbonaceous material; and subsequently washing said carbonaceous material.

The process of the present invention may be used for the beneficiation of any carbonaceous materials containing minerals, such as coal, anthracite, graphite, peat, lignites and oil shale.

The present method is particularly adapted for treatment of black coals containing an appreciable content of reactive minerals.

The present process may also be used on coal washery products or low ash run-of-mine coals to produce significant yields of super clean coal. These yields may be further increased and/or ash levels reduced with subsequent physical cleaning.

When, however, the inventive process is used alone without physical beneficiation, it is capable of significantly altering the ash fusion properties of such black coals. This may be achieved without resort to the use of prior art chemical treatment and without significant size reduction.

In addition, the inventive process is capable of altering some minerals present in coals by ion exchange to give a coal with different, desirable, ash characteristics and hence improve the properties of the coal. In particular, those coals containing alkali feldspars and some swelling clays may be associated with the fouling/slagging properties of coals and/or difficulties experienced with coking coals sticking to the refractory lining of coke ovens thereby resulting in serious damage to the expensive oven linings.

Preferably, where coals are being treated they will be of a particle size generally no greater than a few millimeters.

The treatment may be carried out at ambient temperature conditions or at elevated temperatures (below boiling point of the solution) in which case the treatment time will generally be reduced. Generally, however the treatment time will be about 30 to 45 minutes.

Following treatment with the reagent, the reagent is removed and the coal washed with water to remove excess salts and dissolved minerals. Only mild washing is required. The treated coal, after drying, can, if required, be subjected to physical cleaning methods to obtain cleaner coal fractions or may be left in the dry state without further physical treatment.

Organic compounds are preferred for use as any organic residues remaining in the coal are non-contaminating and non-polluting.

The reagents suitable for use in the process of the present invention are all ammonium salts, polyhydroxy alcohols, organic acids excluding sulphur containing organic acids, organic complexing agents capable of complexing with metal cations, and polysaccharides. Preference is given to those reagents that are cheapest and most easily available.

Examples of suitable ammonium salts are acetate, sulphate, chloride, citrate, hydroxide, carbonate, bicarbonate and oxalate salts.

Examples of suitable polyhydroxy alcohols are glycerol, glycol, ethylene glycol, sorbitol, propylene glycol, mannitol and threitol.

Examples of suitable organic acids are citric, acetic, ascorbic, oxallic, formic, stearic, succinic and adipic acids.

Examples of suitable complexing agents capable of complexing with metal cations are ethylene diamine tetracetic acid (EDTA), disodium salt of EDTA, 8-hydroxyquinoline and mercaptoethanol. The preferred complexing agents are suitable for complexing with transition metal cations.

Examples of suitable polysaccharides are sucrose, maltose, dextrose, lactose, starch, glycogen, cellulose and cellulose derivatives, and galactose.

The present inventors have found that the various reagents of the invention are appropriate for removing or altering different minerals by ion exchange. Thus, ammonium salts are capable of removing sulphate minerals such as gypsum and bassinite and are able to alter exchangeable minerals and feldspar minerals. Organic acids are able to remove carbonate minerals such as calcite, dolomite and siderite, phosphate minerals such apatite and alter feldspar minerals. Citric acid contains no inorganic elements and therefore does not contaminate the product or lead to pollution problems when using the treated coal. It is also of special interest in the context of coalfields such, as those in Queensland because it can be easily and cheaply produced by the fermentation of sugar solutions, available locally, with a suitable mold (e.g., *Aspergillus niger*). Organic complexing agents are also capable of removing phosphate minerals such as apatite and altering feldspar minerals. Polyhydroxy alcohols are capable of removing sulphate minerals and of altering swelling clays, exchangeable minerals and feldspar minerals. Polysaccharides are capable of altering feldspar minerals.

From the above, it will be realized that carbonaceous materials may be treated successfully with various reagents of the invention to achieve selective removal of different mineral species.

It will be understood that a number of different mineral species may be selectively removed by repeating the process of the invention using a different reagent for each repetition.

MODES FOR CARRYING OUT THE INVENTION

Figure 1:
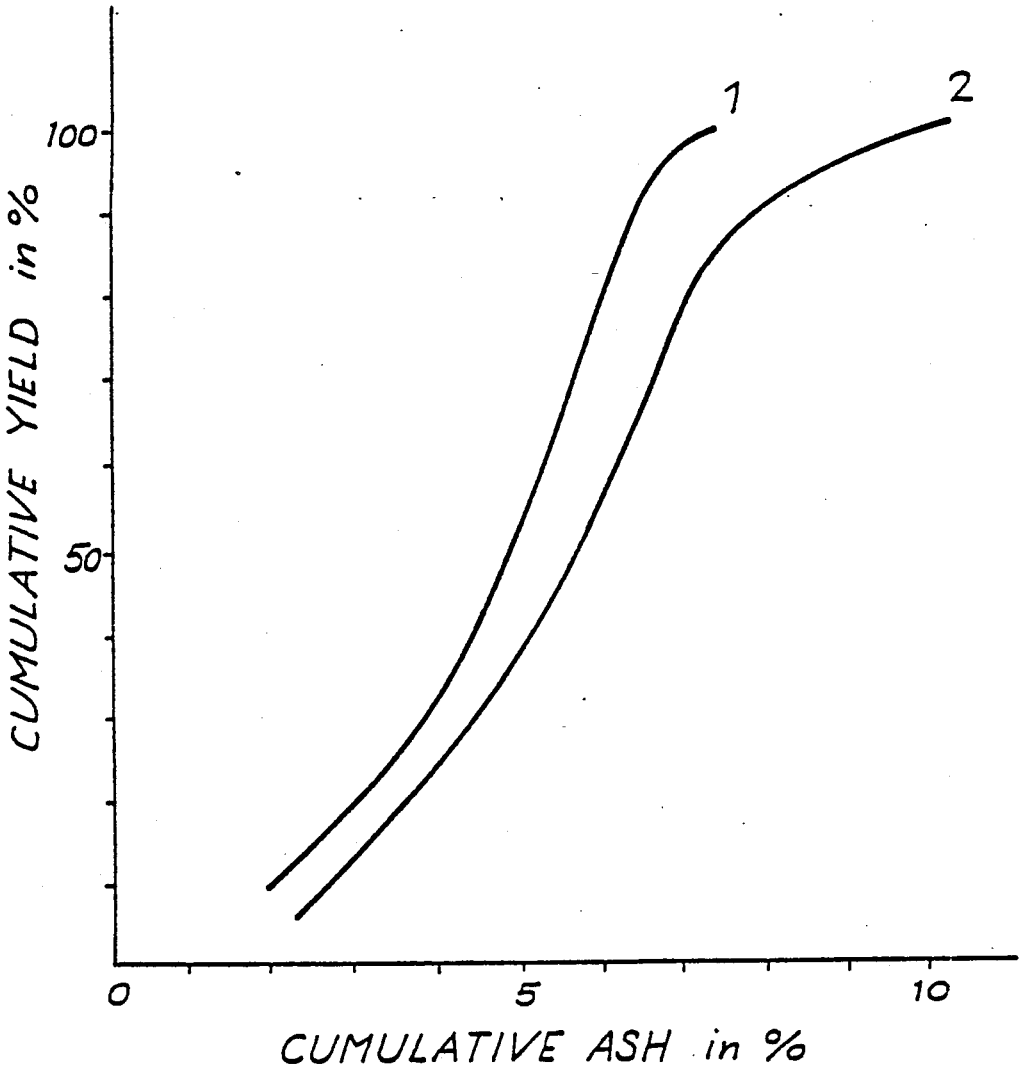
FIG. 1 is a graph of cumulative yield vs. cumulative ash of both starting and treated coal under the conditions of Example 7.

So that the invention may be more clearly understood, there follow seven examples of the application of the invention to prepare a low ash coal, an increased yield of clean coal, and an ash fusion modification.

EXAMPLE 1

Preparation of Low Ash Coal

A coking coal product having a top size of 2 mm was found to have an ash yield of 7.7% after conventional washing. The coal contained several percent of reactive minerals and after treating the coal in 3M citric acid at 80° C. for 30 minutes followed by a second treatment using glycerol at room temperature for 30 minutes, a coal was obtained with an ash yield of 6.6%.

Subsequent float/sink separation at SG 1.6 achieved total recovery of the coal present at a reduced ash level of 4.4%. The sinks fraction was found to contain only quartz and clay indicating greater liberation due to the chemical treatment.

EXAMPLE 2

Increased Yield of Clean Coal

A run-of-mine coal having a 2 mm top particle size and an ash yield of 8.8% on float/sink separation at SG 1.355 gave a 78.8% mass yield at 3.6% ash. The sinks fraction contained 27.9% ash.

The same coal was treated as in Example 1, with 3M citric acid at 80° C. for 30 minutes and was found to have an ash yield of 6.5% and gave an increased floats yield of 87.2% at the same density (SG 1.355) of a floats fraction with an ash of 3.6%. The sinks fraction, which was lower in quantity than in the case of the untreated coal had an ash yield of 26.8%.

From the foregoing, it will be seen that through the use of the inventive process, a 10% increase in recovery of a super clean coal fraction (having an ash content of 1-5%) was obtained with less waste material.

EXAMPLE 3

Ash Fusion Modification

Samples of the coal listed in Table 1 were treated with 3M citric acid solution at 80° C. for 30 minutes, filtered and washed with water. The coals were reslurried with a small quantity of water and ammonium acetate solution. The slurry was stirred for 30 minutes then filtered, water-washed, dried and the ash fusion properties determined.

As shown in Table 1, a comparison of the treated and untreated coals indicates that in all cases the ash fusion temperatures have been substantially increased.

The filtrates were analyzed and indicated that the major elements removed from the coals were calcium, iron, magnesium, phosphorus, sodium and potassium with smaller quantities of most other elements, all of which came from the dissolved minerals.

TABLE 1

ALTERATION OF ASH FUSION PROPERTIES AND REDUCTION IN COAL ASH YIELD BY CHEMICAL LEACHING OF SELECTED MINERALS FROM SAMPLES OF SIX DIFFERENT COALS

| Sample | 1 | 2 | 3 | 4 | 5 | 6 |
|---|---|---|---|---|---|---|
| Properties Before Leaching | | | | | | |
| Ash % (dry basis) | 9.8 | 12.1 | 17.2 | 9.7 | 8.0 | 7.2 |
| Deformation temp °C. | 1280 | 1250 | 1320 | 1440 | 1140 | 1110 |
| Sphere temp °C. | 1530 | 1550 | 1560 | 1600 | 1200 | 1280 |
| Hemisphere temp °C. | 1570 | 1550 | 1580 | 1600 | 1200 | 1300 |
| Flow temp °C. | 1600 | 1580 | 1600 | 1600 | 1340 | 1390 |
| Properties After Leaching | | | | | | |
| Ash % (dry basis) | 8.9 | 10.0 | 15.1 | 9.1 | 6.1 | 5.4 |
| Deformation temp °C. | 1280 | 1600 | 1600 | 1380 | 1290 | 1270 |
| Sphere temp °C. | 1600 | 1600 | 1600 | 1600 | 1600 | 1540 |
| Hemisphere temp °C. | 1600 | 1600 | 1600 | 1600 | 1600 | 1560 |
| Flow temp °C. | 1600 | 1600 | 1600 | 1600 | 1600 | 1600 |

EXAMPLE 4

Phosphorus Removal

A premium Queensland coking coal containing a high phosphorus content (0.15% P) was treated with a molar excess of citric acid at 80° C. for 30 minutes then washed. The coal was separated into two size fractions of −4 mm+2 mm and −2 mm to zero. The reduction in phosphorus from the coal samples was 45% and 89% respectively. The finer size fraction having a phosphorus level of <0.02%. This is a considerable improvement in the quality of coking coal as phosphorus is considered a serious contaminant for metallurgical applications.

EXAMPLE 5

Alkali Removal

A Bowen basin coking coal containing a high proportion of alkali elements namely sodium, potassium, calcium, magnesium and iron was treated with a number of organic acids and complexing agents, ascorbic acid, oxalic acid, citric acid, acetic acid, ethylene diamine tetracetic acid (EDTA), both in a protonated form and as the disodium salt. All reagents showed significant reduction in the basic elements (alkali s) in the coal. Hot citric acid solution and hot EDTA (protonated form) showed the greatest reduction at more than 50%. This reduction is slightly greater than that obtained when the coal was treated with sulfurous acid as shown in the Table II.

The reduction of alkali elements from coals improves both the thermal properties and ash characteristics, and the coking properties.

TABLE II

| | Percent Reduction After Chemical Leaching | |
|---|---|---|
| | Sulfurous ($SO_2$) acid treatment | Complexing Reagent |
| Ash Reduction % | 15% (8.0 to 6.8) | 20% (8.0 to 6.4) |
| Element Reduction % | Fe, Mg, Mn = 30% | Fe, Mg, Na = 50% |
| | Ca = 70% | Ca, Mg = 70% |
| | Na = 50% | |
| | P = 20% | P = 20% |
| | very little change for Si, Al, Ti and K | |
| Basicity Index Reduction | 35–40% | 50% |

$$\text{*BI - Basicity Index} = \frac{Fe_2O_3 + CaO + MgO + Na_2O + K_2O}{SiO_2 + Al_2O_3}$$

The BI is lowered by 35–40% using sulfurous acid and by 50% using the complexing agent.

EXAMPLE 6

Brown Coal Benefication

Brown coals contain minerals, salts and inorganic matter. The latter can be in the form of inorganic humates. Samples of Victorian and South Australian brown coals were treated with a molar excess of hot citric acid for 30 minutes then filtered and washed. The liquors were brightly colored presumably from the iron salts being removed. The reduction in ash was as follows: Victorian brown coal originally 3.5% ash was reduced to 0.6% ash. The South Australian coals were originally 10.0 and 8.0% ash and after treatment were reduced to 3.0% and 2.5% respectively.

The ash from these coals was pale in comparison to the original ash and reflected the removal of iron minerals and iron salts. The resultant ash was rich in silicates.

EXAMPLE 7

Improved Washability Potential

The washability potential of a washery coal was reevaluated after treatment with a molar excess of hot citric acid for 30 minutes. The coal sample (8 mm top size) washability curves are shown in FIG. 1. The results indicate that a cleaner coal can be obtained and that a significant yield increase of a coal at a set ash content can be achieved i.e. 15% increase in coal yield at 7.4% ash. The increases are more marked as the particle size is reduced.

INDUSTRIAL APPLICABILITY

From the foregoing description, it is evident that the inventive process has a capability of increasing coal recovery, improving coal quality, enhancing coal ash fusion characteristics, improving coal industry operations and advancing sales of predictable quality coals.

We claim:

1. A process for the benefication of a solid carbonaceous material which contains at least one mineral consisting essentially of:

(a) forming an aqueous solution of an effective amount of a compound selected form the group consisting of citric acid, acetic acid, ascorbic acid, oxalic acid, formic acid, succinic acid, adipic acid, ethylenediaminetetraacetic acid, a disodium salt of ethylenediaminetetraacetic acid, 8-hydroxyquinoline, mercaptoethanol, sorbitol, mannitol, threitol, sucrose, maltose, dextrose, lactose, starch, glycogen, cellulose, a cellulose derivative and galactose, which compound will react with the at least one mineral and with the provision that in the case of citric acid, the effective amount of the citric acid in this aqueous solution is 3 molar;

(b) contacting said carbonaceous material with said at least one solution at a temperature less than the boiling point of said solution for a sufficient time to allow the compound to react with the at least one mineral to selectively remove or chemically modify at least one mineral contained in said carbonaceous material, said modification resulting in facilitated removal of said mineral by washing in step (c) or resulting in altering ashforming properties of said carbonaceous material to yield improved ash characteristics; and (c) subsequently washing the carbonaceous material with water.

2. A process according to claim 1, wherein steps (a), (b) and (c) are repeated sequentially using a different compound selected from said group for each repetition of step (a).

3. A process according to claim 1, wherein said carbonaceous material is coal.

4. A process according to claim 1, wherein said carbonaceous material is crushed before contacting with said solution.

5. A process according to claim 1, wherein said carbonaceous material has a particle size of less than 3 mm.

6. A process according to claim 1, wherein said step (b) is for the duration of 30 to 45 minutes.

7. A process according to claim 1, wherein said at least one mineral is an exchangeable mineral and/or a feldspar material.

8. A process according to claim 1, wherein said at least one mineral is at least one of an alkaline mineral and a phosphate mineral and said compound is citric acid, acetic acid, ascorbic acid, oxalic acid, formic acid, succinic acid or adipic acid.

9. A process according to claim 8, wherein said mineral comprises an alkaline mineral selected from the group consisting of calcite, dolomite and siderite.

10. A process according to claim 1, wherein said at least one mineral comprises at least one of a sulphate mineral, a phosphate mineral, and an alkali clay; and said compound is ethylenediaminetetraacetic acid, a disodium salt of ethylenediaminetetraacetic acid, 8-hydroxyquinoline or mercaptoethanol.

11. A process according to claim 1, wherein said at least one mineral is at least one of a sulphate mineral, phosphate mineral, and an alkali clay, and said compound is sorbitol, mannitol or threitol.

* * * * *